United States Patent [19]

Deal et al.

[11] Patent Number: 4,563,612

[45] Date of Patent: Jan. 7, 1986

[54] CATHODE-RAY TUBE HAVING ANTISTATIC SILICATE GLARE-REDUCING COATING

[75] Inventors: Samuel B. Deal, Manheim Township, Lancaster County; Donald W. Bartch, Hellam Township, York County; Steven C. Forberger, Manheim Township, Lancaster County, all of Pa.

[73] Assignee: RCA Corporation, Princeton, N.J.

[21] Appl. No.: 624,371

[22] Filed: Jun. 25, 1984

[51] Int. Cl.[4] ..... H01J 31/00

[52] U.S. Cl. ..... 313/478; 313/313; 313/479

[58] Field of Search ..... 313/477 HC, 478, 313, 313/479, 477 R; 361/212

[56] References Cited

U.S. PATENT DOCUMENTS

| | | | |
|---|---|---|---|
| 3,431,454 | 3/1969 | Sanders | 315/85 |
| 3,504,212 | 3/1970 | Wollentin et al. | 313/478 X |
| 3,576,356 | 4/1971 | Hyman | 350/156 |
| 3,635,751 | 1/1972 | Long, III et al. | 117/94 |
| 3,898,509 | 8/1975 | Brown, Jr. et al. | 313/478 |
| 3,940,511 | 2/1976 | Deal et al. | 427/165 |
| 4,243,913 | 1/1981 | Nero | 315/85 X |
| 4,385,256 | 5/1983 | Tokita et al. | 315/85 X |
| 4,422,721 | 12/1983 | Hahn et al. | 350/164 |

*Primary Examiner*—Robert Yoncoskie

*Attorney, Agent, or Firm*—Eugene M. Whitacre; Dennis H. Irlbeck; LeRoy Greenspan

[57] ABSTRACT

A cathode-ray tube comprising a glass viewing window having, on its external viewing surface, an antistatic, glare-reducing, image-transmitting coating. The coating has a rough surface and is composed essentially of a silicate material and a metallic compound in proportions to impart the desired antistatic characteristic without substantially degrading the image-transmitting capability of the coating. When the tube is operated, the coating is grounded either directly or through the metal implosion-prevention system on the tube.

11 Claims, 2 Drawing Figures

CATHODE-RAY TUBE HAVING ANTISTATIC SILICATE GLARE-REDUCING COATING

BACKGROUND OF THE INVENTION

This invention relates to a novel cathode-ray tube comprising a glass viewing window having, on its viewing surface, a glare-reducing image-transmitting silicate coating that is also antistatic; that is, it does not accumulate electronic charge on its surface.

Glare-reducing silicate coatings for the glass viewing windows of cathode-ray tubes have been disclosed previously. See, for example, U.S. Pat. Nos. 3,114,668 to G. A. Guiles, 3,326,715 to R. G. Twells, 3,635,751 to G. E. Long, III et al. and 3,898,509 to M. G. Brown, Jr. et al. Such coatings do not depend on destructive interference of the ambient light. Instead, the surfaces of these coatings have controlled roughnesses so that the ambient light is scattered in such manner that the brightness and resolution of reflections are reduced. The coatings may contain small amounts of fine carbon particles to reduce in a controlled manner the brightness of a transmitted light image.

When prior cathode-ray tubes with the above-mentioned coatings are operated, they accumulate static charge on the viewing surfaces of the coatings. Static charge on the viewing surface of a cathode-ray tube is objectionable from many standpoints. Static charge attracts dust to the viewing surface. Also, it can produce a mild electric shock when it is touched. Mild electric shock may occur where the tube is used for entertainment or for the display of data.

SUMMARY OF THE INVENTION

The novel cathode-ray tube comprises a glass viewing window having, on its external viewing surface, an antistatic, glare-reducing, image-transmitting coating. The coating has a rough surface for imparting the glare-reducing characteristic and consists essentially of a silicate material and an inorganic metallic compound for imparting the desired antistatic characteristic to the coating. The metallic compound may be a compound of at least one element selected from the group consisting of platinum, palladium, tin and gold. When the tube is operated, the coating is grounded either directly or through the metal implosion system on the tube.

Some additive materials, such as carbon, are known to produce an antistatic characteristic to a silicate coating. However, such previous additive materials must be added in such large proportions to achieve the antistatic characteristic that they degrade the image-transmitting characteristic to an unacceptable degree. The metallic compounds comprising the novel cathode-ray tube are present in small concentrations that impart the desired antistatic characteristic but do not degrade the optical characteristics of the coating to any substantial degree. The preferred palladium compound in the preferred lithium silicate coating is present in concentrations in the range of 0.005 to 0.02 weight percent of the coating.

DESCRIPTION OF THE PREFERRED EMBODIMENTS

Figure 1:
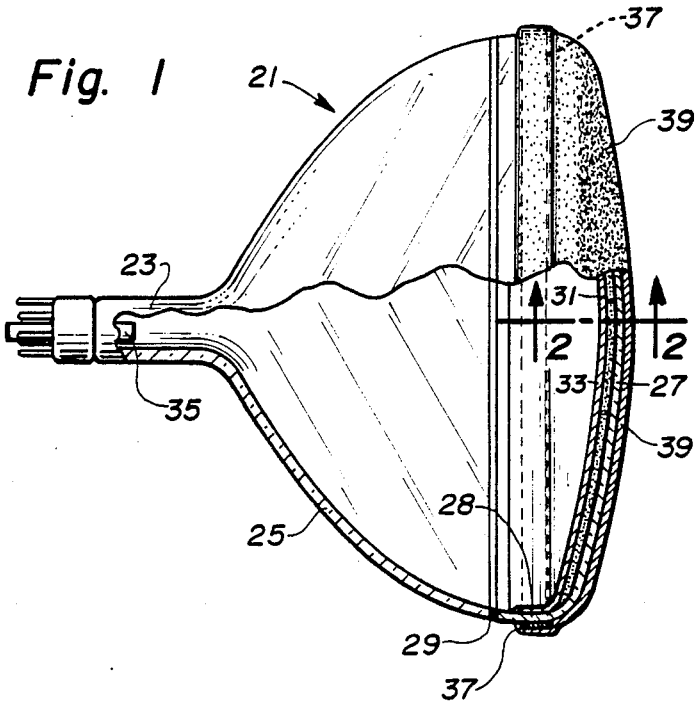
FIG. 1 is a partially-broken away longitudinal view of a cathode-ray tube including the novel viewing screen of the invention.
Figure 2:
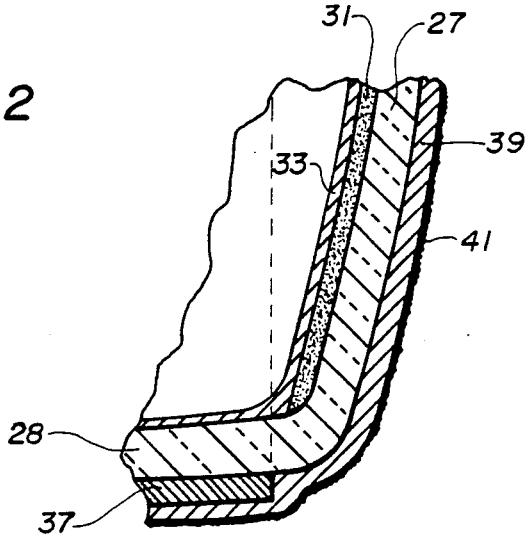
FIG. 2 is an enlarged sectional view through a fragment of the faceplate of the tube illustrated in FIG. 1 along section lines 2—2.

The cathode-ray tube illustrated in FIG. 1 includes an evacuated envelope, designated generally by the numeral 21, which includes a neck 23 integral with a funnel 25 and a faceplate or panel comprising a glass viewing window 27 and a peripheral sidewall or flange 28. The flange 28 is joined to the funnel 25 by a seal 29, preferably of a devitrified glass. A luminescent coating 31 of a phosphor material is applied to the interior surface of the window 27. A light-reflecting metal coating 33, as of aluminum, is applied to the luminescent coating 31 as shown in detail in FIG. 2. The luminescent coating 31, when being suitably scanned by an electron beam from a gun 35, is capable of producing a luminescent image which may be viewed through the window 27. A tensioned metal band 37 is located around the flange 28 for preventing implosion of the envelope. A glare-reducing coating 39 having a rough external surface 41 and consisting essentially of a lithium silicate material and a palladium compound is applied to the external surface of the faceplate 27 and overlaps the metal band 37. Alternatively, the coating 39 may extend under the band 37 and the band 37 overlap the coating 39. In still other embodiments, there may be other arrangements for contacting the coating 39 for connecting the coating with an electrically-conducting path to ground potential. Inasmuch as the invention is concerned primarily with the faceplate 27 and the external coating thereon, a description of the electron-emitting components and other parts normally associated with the neck 23 and funnel 25 is omitted or shown schematically.

The glare-reducing coating 39 may be produced by the method disclosed in U.S. Pat. No. 3,940,511 issued Feb. 24, 1976. The faceplate 27 may be part of a tube which has already been evacuated and sealed off at the time the glare-reducing coating is produced. One advantage of the novel coating and method is that it may be produced after the tube has been otherwise completely fabricated. Alternatively, the glass plate may be an implosion protection plate which is to be adhered to the external surface of the faceplate 27 by a suitable adhesive, or a faceplate during tube fabrication.

By the preferred process, a clean glass support, such as the faceplate 27 of an evacuated and sealed tube 21, is warmed to about 30° C. to 100° C. as in an oven. The external surface of the warm faceplate 27 and the tensioned metal band 37 around the faceplate 27 are coated with a dilute aqueous solution of a lithium-stabilized silica sol and a water-soluble metallic compound, such as palladium sulfate, tin sulfate, tin chloride or gold chloride. The coating may be applied in one or several layers by any conventional process, such as by spraying. The temperature of the faceplate, the specific technique for applying the coating and the number of layers applied are chosen empirically to produce a coating with the desired thickness. The temperature of the faceplate is preferably about 35° to 55° C. Temperatures that are too low (e.g. 20° C.) cause the coating to bead, while temperatures that are too high produce coatings which give a dry appearance. It has been found that, when applying the coating by spraying, the dry coating thickness should be such as to permit the operator to resolve the three bulbs of the reflection of a three-bulb fluorescent light fixture located about 6 feet above the glass support. A thicker initial coating results in a thicker final coating. Generally, the thicker the coating, the greater the reduction in glare and the greater the loss in resolution of the luminescent image. Conversely, the thinner the coating, the lesser the reduction in glare and the lesser the loss in resolution of the luminescent image.

Also, when applied by spraying, the coating takes on an appearance of dryness. Greater dryness is achieved (1) by using higher panel temperatures while applying the coating, (2) by using more air in the spray when spraying with compressed air, (3) by using a greater spraying distance when spraying on the coating, and (4) by increasing the mole ratio of $SiO_2/Li_2O$. But, when this is overdone, the coating crazes. The greater the appearance of dryness, the greater the glare reduction and the greater the loss in resolution of the luminescent image. Conversely, the lesser the appearance of dryness, the lesser the glare reduction and the lesser the loss in resolution of the luminescent image.

The coating composition is an aqueous lithium-stabilized silica sol containing about 1 to 10 weight percent solids and 0.005 to 0.02 weight percent metallic element of the metallic compound, with respect to the weight of the total solids in the sol. The metallic element may be one or more of platinum, palladium, tin and gold and is introduced into the sol as a water-soluble salt, preferably. Generally, any of the metallic elements that are used to sensitize surfaces for electroless plating may be used as one or more of the metallic elements in the novel tube. Where the concentration of the metallic element is below about 0.005 weight percent, the antistatic characteristic may be insufficient or may be erratic. Where the concentration of the metallic element is above about 0.02 weight percent, the coating may be mottled, iridescent or the transmission otherwise adversely affected. In the sol, the ratio of $SiO_2$ to $Li_2O$ is from about 4:1 to about 25:1. The silica sol is substantially free of alkali metal ions other than lithium and is substantially free of anions other than hydroxyl. The lithium-stabilized silica sol differs substantially from a lithium silicate solution, which is a compound dissolved in a solvent and not a sol. Upon subsequent baking, a lithium-sol coating dries to form a lithium-silicate coating. For the novel tube, a solution of a silicate of one or more of lithium, sodium and potassium may substitute for the lithium-stabilized sol. Also, an organic silicate such as tetraethyl orthosilicate may substitute for the preferred lithium-stabilized silica sol. The formulation may also contain pigment particles and/or dyes to reduce the brightness up to about 50 percent of its initial value and/or to modify the spectral distribution of the transmitted image.

After coating the warm glass support, the coating is dried in air with care to avoid the deposition of lint or other foreign particles on the coating. Finally, the dry coating is heated at between 150° C. and 300° C. for 10 to 60 minutes. Baking at temperatures between about 150° C. and 300° C. permits the coating to be applied directly to the tube face after the tube has been exhausted and sealed. Baking at temperature above 300° C. may disturb fabricated structures in the tube. Generally, the higher the heating temperature, the lower will be the glare reduction in the product and the higher will be the abrasion resistance. The coating may be recycled through the heating step. Recycling at a particular temperature has the effect of reaching a stable point.

The product of the novel method is a cathode-ray tube having a novel antistatic glare-reducing coating on its viewing surface. The coating has the quality of glare reduction; that is, scattering of reflected light; and at the same time transmission of the luminescent image on the phosphor coating with a resolution of at least 500 lines per inch. The glare-reducing coating is chemically stable to manufacturing processes and to subsequent exposure to humid atmospheres. The coating resists abrasion and exhibits a substantially flat spectral response to both reflected and transmitted light.

In addition, unlike prior silicate glare-reducing coatings, the coating on the novel tube is antistatic. With prior operating tubes, when an operator's hand is wiped across the viewing surface of the window, a crackling sound is heard, and the hair on the operator's arm will stand out. If a plastic ruler is held against the viewing surface with one of the operator's hands and the other hand is held on the grounded metal frame of the equipment, the operator will experience a shock due to the static charge stored on the viewing surface. With the novel tube, none of these phenomena is experienced by the operator when the antistatic glare-reducing coating is grounded either directly or through the metal implosion-prevention structure on the tube.

Some quarter-wave glare-reducing coatings (which depend on destructive interference of the ambient light) on the viewing windows of cathode-ray tubes are disclosed in the prior art to have an antistatic characteristic. Such prior coatings are structurally different from the glare-reducing coatings disclosed herein. Such prior coatings are also more costly and more difficult to make, are less resistant to abrasion, and are less resistant to ordinary factory heat treatments than the coatings disclosed herein.

EXAMPLE

The faceplate surface of a 25-inch rectangular color-television-picture tube that is exhausted, sealed and based is cleaned to remove dirt, oil, scum, etc. by any of the known scouring and washing procedures. Then the surface is wiped with a 5-weight-percent ammonium bifluoride solution and rinsed with deionized water. The window of the faceplate has a neutral optical density with about 69 percent light transmission. The assembly is heated at about 40° to 45° C. for about 30 minutes. A liquid coating composition is sprayed onto the warm glass surface. The coating composition is prepared by mixing 45 ml. Lithium Silicate 48 (a lithium-stabilized silica sol containing 22.1% solids, 1.17 sp. gr.) marketed by E. I. DuPont Company, Wilmington, DE, 1.75 ml. Palladium D.N.S. solution (4.0 grams of palladium/100 ml. of solution) marketed by Johnson Matthey Inc., Malvern, PA and 455 ml. deionized or distilled water. The silica sol has a mol ratio of $SiO_2$ to $Li_2O$ of about 4.8. Using a DeVilbis No. 501 spray gun, the composition is sprayed at about 25 psi air pressure as a wide fan spray having a high air-to-liquid ratio. Ten to 50 passes of the spray are required to build up the coating to the required thickness. The spray application is stopped about when the greatest thickness at which the reflection from the three bulbs of an ordinary three-bulb fluorescent light fixture spaced about six feet above the panel can still be resolved or distinguished by the operator on the coating. The final coating is less than about 0.0001 inch thick. Because of the temperature of the panel, the thickness of the coating, and the high air content of the spray, each coating pass dries quickly after deposition. The assembly is then baked for about 10 minutes at about 120° C. and entails about a 30-minute period to rise to this temperature and about a 30-minute period to cool back to room temperature. The baking develops the final electrical, optical and physical properties of the glare-reducing coating. For coatings made in this manner, neither the optical properties of the coating nor the abrasion resistance was degraded when the panel was exposed for 18 hours in a 100° F., 95 percent relative humidity atmosphere. The final coating, when grounded, does not store electrostatic charge when the tube is operated in a normal manner. A similar tube with no palladium compound present in the coating, when grounded, stores considerable electrostatic charge when operated in a normal manner.

What is claimed is:

1. A cathode-ray tube comprising a glass viewing window having, on its external viewing surface, an antistatic, glare-reducing image-transmitting coating, said coating having a rough surface for imparting said glare-reducing characteristics and consisting essentially of a silicate material which accumulates static charge during the operation of said tube, and an inorganic metallic compound present in operative concentrations for imparting said antistatic characteristic to said coating.

2. The cathode-ray tube defined in claim 1 wherein said metallic compound comprises at least one element selected from the group consisting of platinum, palladium, tin and gold.

3. The cathode-ray tube defined in claim 2 wherein said metallic compound is present in said coating in sufficient concentration to impart said antistatic characteristic to said coating and insufficient concentration to degrade substantially said image-transmitting characteristic of said coating.

4. The cathode-ray tube defined in claim 2 wherein said silicate material is a silicate of at least one alkali metal selected from the group consisting of sodium, potassium and lithium.

5. The cathode-ray tube defined in claim 2 wherein said silicate material consists essentially of lithium silicate.

6. The cathode-ray tube defined in claim 5 wherein said metallic compound is a compound of palladium.

7. The cathode-ray tube defined in claim 6 wherein said palladium of said palladium compound is present in said coating in concentrations in the range of 0.005 to 0.020 weight percent.

8. The tube defined in claim 1 including contacting means to said coating for connecting said coating with an electrically-conducting path to ground potential.

9. The tube defined in claim 8 wherein said contacting means includes a metal implosion-prevention structure on said tube in physical contact with said coating.

10. The tube defined in claim 9 wherein said contacting means includes a tensioned metal band around said tube and said coating overlaps said band.

11. The tube defined in claim 9 wherein said contacting means includes a tensioned metal band around said tube and said band overlaps said coating.

* * * * *